US008421361B2

(12) United States Patent
Chen et al.

(10) Patent No.: US 8,421,361 B2
(45) Date of Patent: Apr. 16, 2013

(54) BACKLIGHT CONTROL CIRCUIT AND METHOD THEREOF

(75) Inventors: Jian-Kao Chen, Hsinchu Hsien (TW); Chih Chiang Hsu, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 269 days.

(21) Appl. No.: 13/073,100

(22) Filed: Mar. 28, 2011

(65) Prior Publication Data

US 2012/0019167 A1 Jan. 26, 2012

(30) Foreign Application Priority Data

Jul. 20, 2010 (TW) ..... 99123758 A

(51) Int. Cl.
*H05B 37/03* (2006.01)
*G09G 3/36* (2006.01)

(52) U.S. Cl.
USPC ..... 315/151; 315/307; 345/102; 345/207

(58) Field of Classification Search ..... 315/151, 315/246, 291, 294, 307; 345/87, 102, 207
See application file for complete search history.

(56) References Cited

U.S. PATENT DOCUMENTS

2002/0158971 A1* 10/2002 Daiku et al. ..... 348/226.1
2010/0079368 A1* 4/2010 Ichikawa ..... 345/102
2012/0147068 A1* 6/2012 Gondo ..... 345/690
2012/0200800 A1* 8/2012 Kurita ..... 349/61
2013/0002529 A1* 1/2013 Onogi ..... 345/102

* cited by examiner

*Primary Examiner* — Don Le
(74) *Attorney, Agent, or Firm* — Edell, Shapiro & Finnan, LLC

(57) ABSTRACT

A backlight control circuit and method thereof are provided to control the backlight of a backlight module so as to enhance the dynamic contrast ratio and save power. The backlight control circuit includes an average luminance detection circuit, a luminance distribution detection unit, a pulse width control circuit and a pulse width modulator. The average luminance detection circuit detects the average luminance of a frame which includes a plurality of pixels; the luminance distribution detection unit detects the pixel luminance distribution of the frame; the pulse width control circuit generates a pulse width control signal according to the average luminance and the pixel luminance distribution of the frame; and the pulse width modulator generates a pulse width modulation (PWM) signal according to the pulse width control signal, so as to control the backlight of the backlight module.

20 Claims, 6 Drawing Sheets

BACKLIGHT CONTROL CIRCUIT AND METHOD THEREOF

CROSS REFERENCE TO RELATED PATENT APPLICATION

This patent application is based on Taiwan, R.O.C. patent application No. 99123758 filed on Jul. 20, 2010.

FIELD OF THE INVENTION

The present invention relates to a display device, and more particularly, to a backlight control circuit and method thereof.

BACKGROUND OF THE INVENTION

It is desirable to achieve a higher dynamic contrast ratio in a display device so that a better visual effect can be achieved. However, in conventional display devices using a LED backlight or Cold Cathode Fluorescent Lamp (CCFL) backlight, the backlight is set at a maximum brightness no matter what the brightness of the frames are. This setting consumes a great amount of power as well as causes poor dynamic contrast ratio.

SUMMARY OF THE INVENTION

The present invention provides a backlight control circuit and method thereof, which can be used to control the backlight of a display device, for upgrading the dynamic contrast ratio thereof and for reducing power consumption.

According to one embodiment, a backlight control circuit is provided that comprises: an average luminance detection circuit, for detecting the average luminance of a to-be-displayed frame of a display device, wherein the frame includes a plurality of scanning lines, and each scanning line includes a plurality of pixels, wherein, the average luminance detection circuit calculates the pixel average luminance of each scanning line, and calculates the average of the pixel average luminance of the scanning line, to detect the average luminance of the frame; a pulse width control circuit, which is coupled to the average luminance detection circuit, for comparing the average luminance of the frame with a reference luminance, and outputting a pulse width control signal, wherein, the reference luminance corresponds to a reference pulse width, and the pulse width control signal corresponds to a pulse width adjustment; and a pulse width modulator, which is coupled to the pulse width control circuit, for generating a pulse width modulation (PWM) signal according to the pulse width control signal, and transmitting the PWM signal to the backlight module of the display device for controlling the backlight of a backlight module, wherein, the pulse width of the PWM signal is dependent on the reference pulse width and the pulse width adjustment.

Another embodiment of the present disclosure provides a backlight control circuit that comprises: an average luminance detection circuit, for detecting the average luminance of a to-be-displayed frame of a display device, wherein the frame comprises a plurality of pixels; a luminance distribution detection unit, for detecting the pixel luminance distribution of the frame; a pulse width control circuit, which is coupled to the average luminance detection circuit and the luminance distribution detection unit, for generating a pulse width control signal according to the average luminance and pixel luminance distribution of the frame; and a pulse width modulator, which is coupled to the pulse width control circuit, for generating a pulse width modulation (PWM) signal according to the pulse width control signal, so as to control the backlight of the backlight module.

Another embodiment of the present invention provides a backlight control method, comprising: detecting the average luminance of a to-be-displayed frame of a display device, wherein the frame comprises a plurality of scanning lines, and each scanning line includes a plurality of pixels, wherein, the detecting step includes calculating the pixel average luminance of each scanning line, and calculating the average of the pixel average luminance of the scanning line, to detect the average luminance of the frame; comparing the average luminance of the frame with a reference luminance, and outputting a pulse width control signal, wherein, the reference luminance corresponds to a reference pulse width, and the pulse width control signal corresponds to a pulse width adjustment; and generating a pulse width modulation (PWM) signal according to the pulse width control signal, for controlling the backlight of a backlight module, wherein, the pulse width of the PWM signal is dependent on the reference pulse width and the pulse width adjustment.

Another embodiment of the present invention provides a backlight control method, comprising: detecting the average luminance of a to-be-displayed frame of a display device, wherein the frame includes a plurality of pixels; detecting the pixel luminance distribution of the frame; generating a pulse width control signal according to the average luminance and pixel luminance distribution of the frame; and generating a pulse width modulation (PWM) signal according to the pulse width control signal, for controlling the backlight of a backlight module.

The advantages and spirit related to the present invention can be further understood via the following detailed description and drawings.

The following description and figures are disclosed to gain a better understanding of the advantages of the present invention.

DETAILED DESCRIPTION OF THE PREFERRED EMBODIMENT

The embodiments of the present invention are used to control a backlight module in a display device, such as a LCD monitor, in such a way that the dynamic contrast ratio is increased while the power consumption is reduced.

Figure 1:
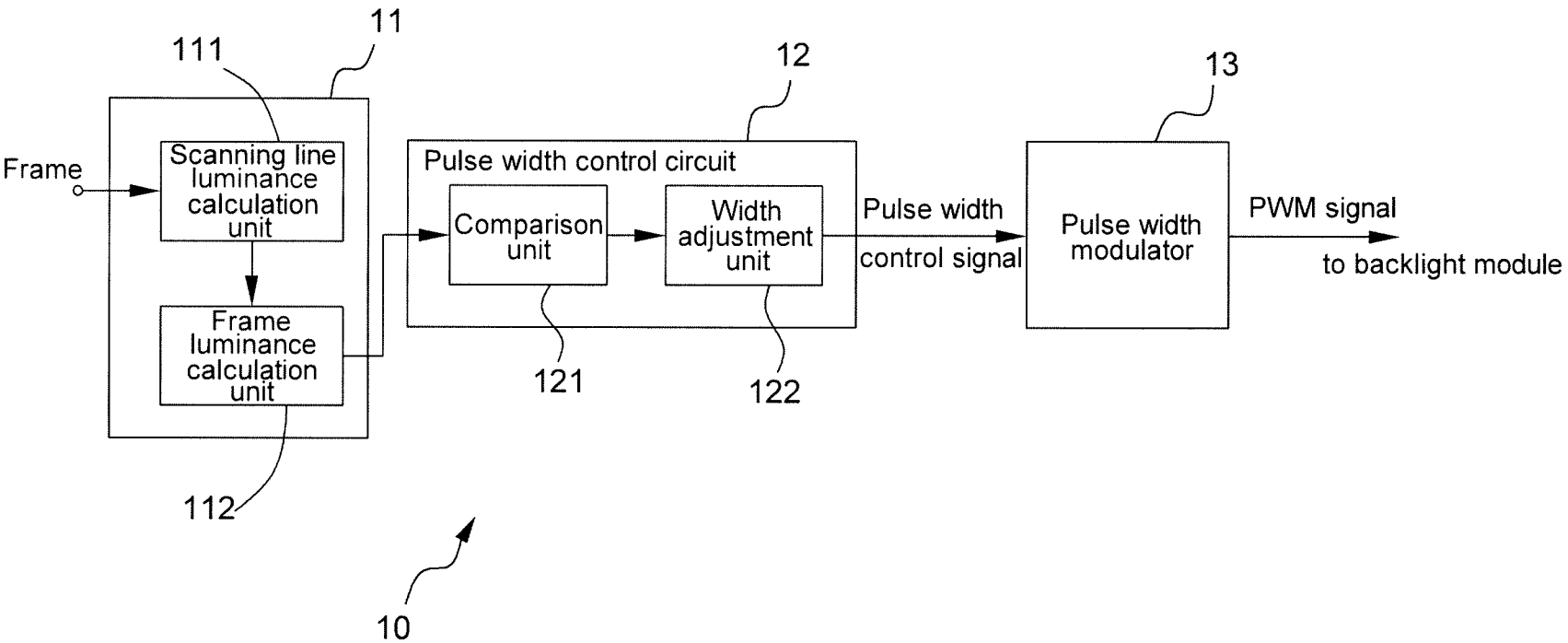
FIG. 1 is a block diagram of a backlight control circuit in accordance with an embodiment of the present invention.

FIG. 1 is a block diagram of the backlight control circuit 10 according to an embodiment of the present invention. The backlight control circuit 10 comprises an average luminance detection circuit 11, a pulse width control circuit 12 and a pulse width modulator 13. In the embodiment, before the display displays a frame on the display device, the backlight control circuit 10 detects the average luminance of the frame, for adjusting the pulse width of the generated pulse width modulation signal according to the detection result, i.e., the duty cycle is adjusted. Then, the generated PWM signal is transmitted to the backlight module of the display device. The backlight module provides backlight to display frames on the display device. The backlight module can be a LED backlight source, for example. The luminance of the backlight source is proportional to the pulse width of the PWM signal. As a result, the intensity of the backlight can be controlled by adjusting the size of the pulse width.

The average luminance detection circuit 11 can detect the average luminance of a frame that is to be displayed. It is known that the frame comprises a plurality of scanning lines, and each scanning line includes a plurality of pixels. The average luminance detection circuit 11 comprises a scanning line luminance calculation unit 111 and a frame luminance calculation unit 112. The scanning line luminance calculation unit 111 can calculate the pixel average luminance of each scanning line of the frame; the frame luminance calculation unit 112 is coupled to the scanning line luminance calculation unit 111 to sum up the pixel average luminance of the scanning lines and compute the average value from the summation; the obtained average value is the average luminance of the frame. In comparison to the traditional technique, this mode of detecting the average luminance of a frame is relatively simple and can provide a reduction in hardware requirements. Taking a frame with 1024*768 resolution as an example, if the luminance value of each pixel is 8 bits, the mode adopted in the traditional technique is to add up all the luminance value of the 8 bits of the 1024*768 pixels first, then divide the sum by 1024*768 to obtain the average value. With such an approach, the cost of hardware is relatively high because the sum of the luminance values may be very large, requiring the number of bits to be high. On the other hand, in the embodiment of the present invention, the pixel average luminance of each scanning line is calculated first, that is, only luminance values with 8 bits of all 1024 pixels are summed up, then the sum of the luminance values is divided by 1024; and then, the pixel average luminance of the 768 scanning lines is calculated by averaging the summation of the pixel average luminance of total 768 scanning lines. Hence, compared with the traditional technology, the calculation approach of the instant embodiment is simpler and uses less hardware. The pulse width control circuit 12 includes a comparison unit 121 and a width adjustment unit 122. The comparison unit 121 receives the average luminance of the frame from the average luminance detection circuit 11, and compares the average luminance of the frame with a reference luminance to output a luminance difference. For example, the luminance difference may be the difference between the average luminance of the frame and the reference luminance. The average luminance of the frame may be stored in a register (not shown) temporarily; the comparison unit 121 may compare the average luminance of the frame prior to the present frame with the reference luminance, for generating a previous luminance difference, then compare the previous luminance difference with the present luminance difference described above (i.e., the luminance difference between the average luminance of the present frame and the reference luminance). If the difference is less than a threshold value, then the comparison unit 121 outputs the previous luminance difference instead of the luminance difference described above. In other words, it is determined that the average luminance of the frame has changed only when the variation of the two average luminance of the two adjacent frames is greater than a certain level. Thus, misjudgment as a result of noise interference can be avoided when detecting the average luminance of the frame. The threshold value described above may be determined according to the signal strength of the noise.

The width adjustment unit 122 generates a pulse width control signal according to the luminance difference output from the comparison unit 121, and transmits the pulse width control signal to the pulse width modulator 13 for modulating the pulse width of the PWM signal generated by the pulse width modulator 13. In short, in the instant embodiment of the present invention, adjustment to PWM pulse width is based on the luminance difference value described above.

Figure 2:
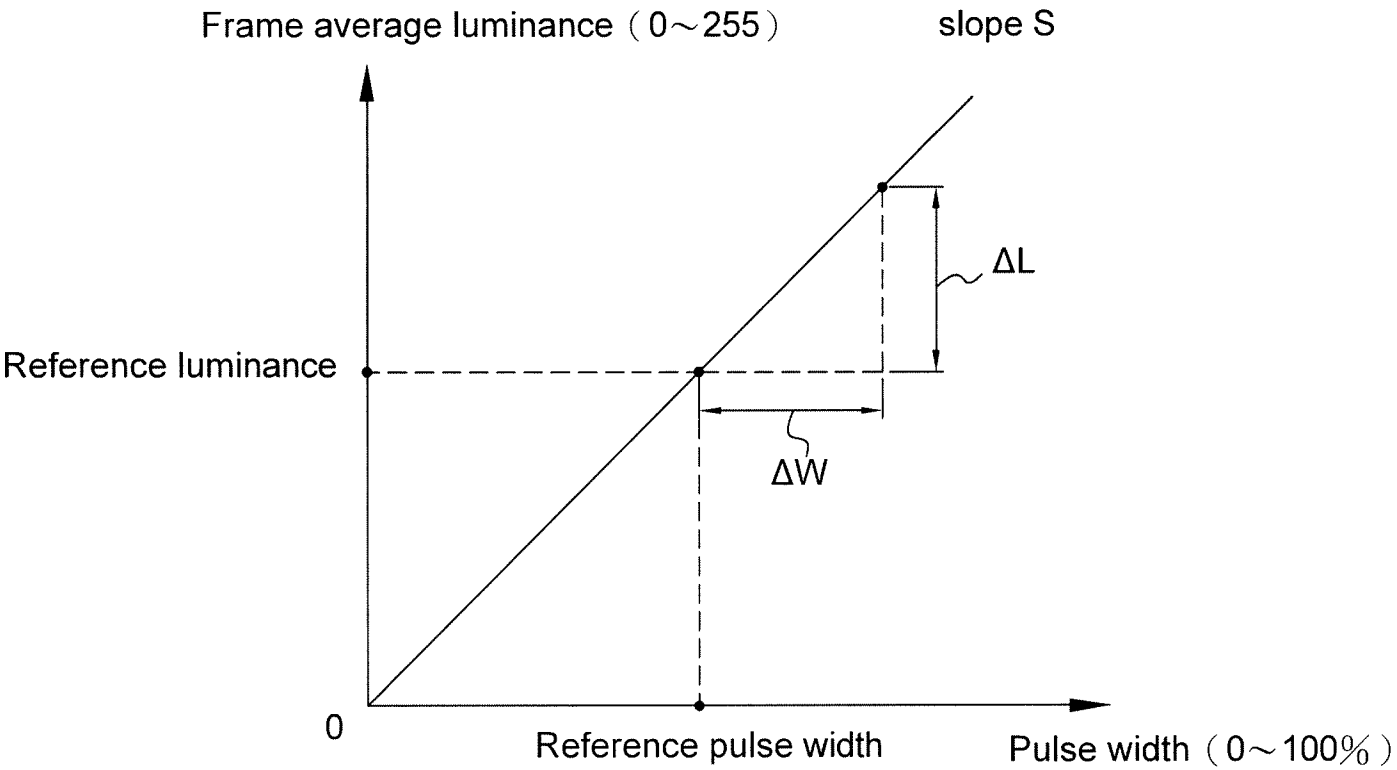
FIG. 2 depicts the relationship of the pulse width of the PWM signal and the average luminance of the frame in the embodiment shown in FIG. 1.

FIG. 2 illustrates the relationship between the pulse width of the PWM signal and the average luminance of the frame in the instant embodiment, where the X-axis indicates the pulse width value, presented in percentage (%), representing the percentage of one pulse width out of one entire PWM cycle; the Y-axis indicates the average luminance value of the frame, presented in 8 bits with a range of 0-255. In FIG. 2, the reference luminance value is mapped to a reference pulse width such that when the average luminance of the frame is equal to the reference luminance, the pulse width of the PWM signal is equal to the reference pulse width. The reference luminance may be defined as the mid-value in the entire luminance scale. In FIG. 2, for example, the range of the luminance is scaled from 0 to 255, so the reference luminance may be set as 128. In the embodiment, the pulse width and the average luminance of the frame has a linear relationship where the slope is s, hence, by knowing luminance difference value $\Delta L$, the pulse width adjustment value $\Delta W$ can be obtained, where $\Delta W=\Delta L/s$ (%), which means the pulse width adjustment value is in proportion to the luminance difference value. It is preferred that by adjusting slope s, the width adjustment unit 122 alters the change in the pulse width adjustment value in accordance with the luminance difference. In one embodiment, to avoid excessive change in backlight luminance (which may cause damage to the display device) with the change in frame luminance, the slope s may be adjusted to be steeper so that the change in adjustment value of the pulse width can be smaller compared to that of a more flat slope with the same amount of change of the luminance difference. Taking 1/s as a gain, then the adjustment value of the pulse width is the product of the luminance difference and the gain.

The pulse width of the original PWM signal generated from the pulse width modulator 13 is a reference pulse. As such, it can control the pulse width modulator 13 to adjust the pulse width of the PWM signal according to the pulse width adjustment value described above by using the pulse control signal provided by the pulse width adjustment unit 122. Consequently, in the embodiment in FIG. 2, the pulse width (W) of the PWM signal is dependent on the reference pulse width (Wr) and the pulse width adjustment ($\Delta W$), which is presented as $$W=Wr+\Delta W \tag{1}$$

The pulse width modulator 13 transmits the PWM signal to the backlight module of the display device to control the backlight. With reference to FIG. 2, for example, if the reference pulse width is 50%, and the pulse width adjustment is 20%, then according to formula (1), the pulse width modulator 13 will generate a PWM signal whose pulse width is 70% (i.e. the duty cycle of the PWM signal is 70%).

In the embodiment, the luminance of the backlight is proportional to the pulse width of the PWM signal, and also proportional to the average luminance. The luminance of the backlight may change with the average luminance. For example, it maintains a high luminance when the image frame is at high brightness, and it will get dimmer when the frame is less bright. In comparison to the traditional technique where the backlight is always at high luminance no matter how bright the frames are, the backlight control circuit of the present invention provides improved dynamic contrast ratio and less power is consumed.

Figure 3:
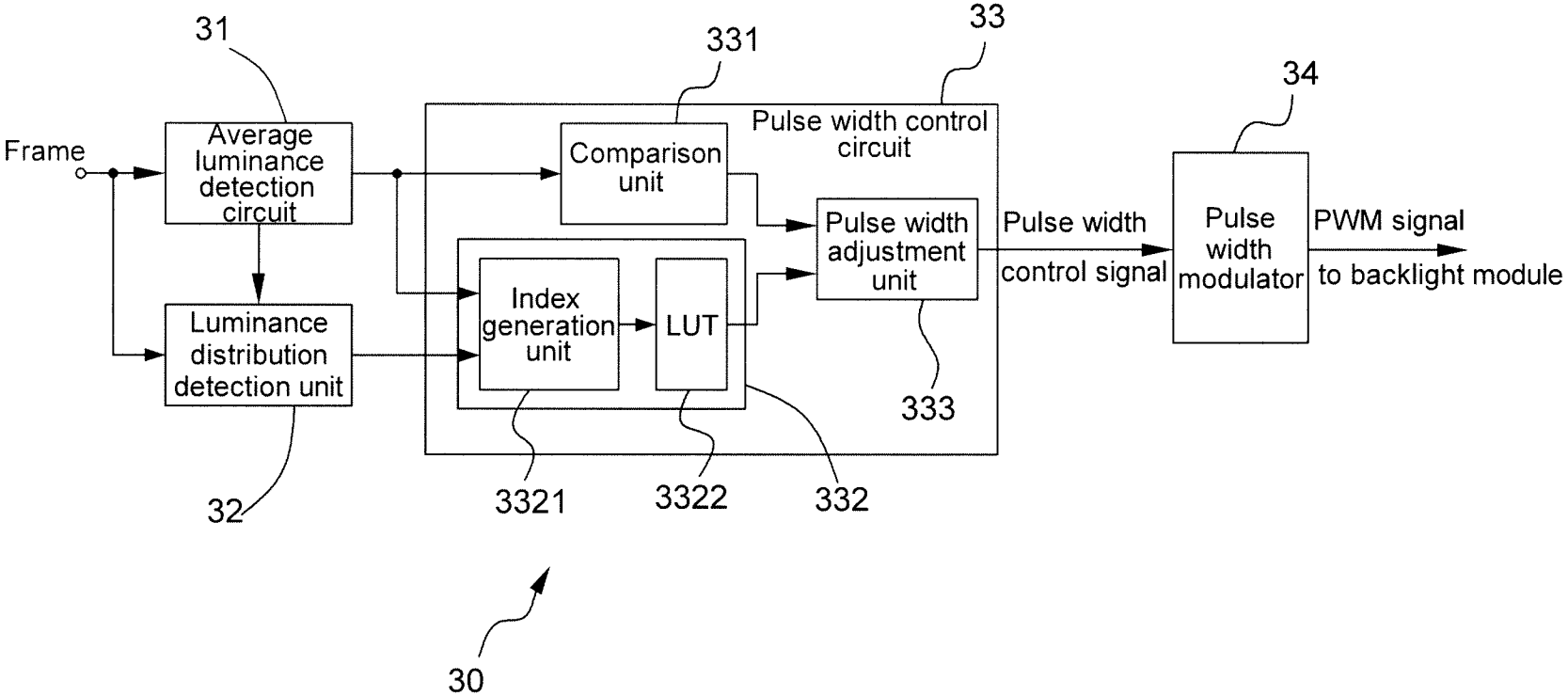
FIG. 3 is a block diagram of a backlight control circuit in accordance with another embodiment of the present invention.

FIG. 3 is a block diagram of a backlight control circuit 30 according to another embodiment of the present invention. As shown in FIG. 3, the backlight control circuit 30 comprises: an average luminance detection circuit 31, a luminance distribution detection unit 32, a pulse width control circuit 33 and a pulse width modulator 34. The backlight control circuit 30 still detects the pixel luminance distribution of the frame except for detecting the average luminance of the frame before displaying a frame on the display device screen, and determines the pulse width of the desired PWM signal according to both detection results.

Figure 4:
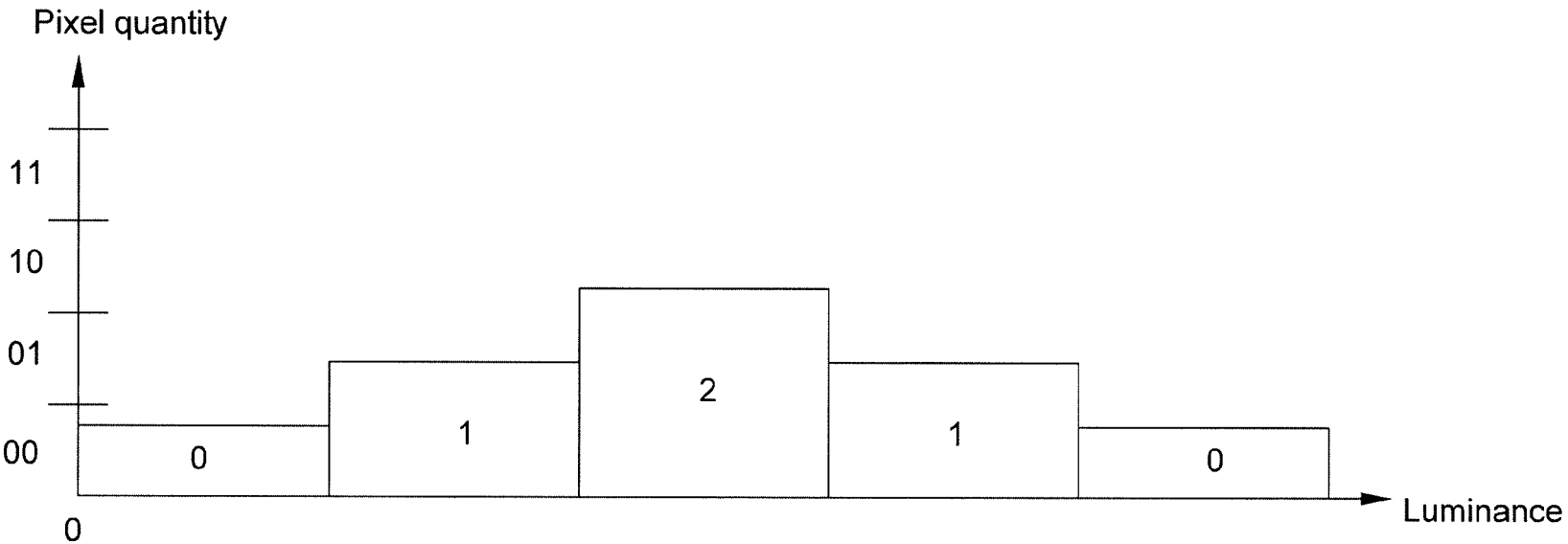
FIG. 4 depicts the frame pixel luminance distribution in accordance with an embodiment of the present invention.

The operation mode of the average luminance detection circuit 31 shown in FIG. 3 is similar to that of the average luminance detection circuit 11 shown in FIG. 1. The luminance distribution detection unit 32 can detect the pixel luminance distribution of the frame, for example, the luminance distribution detection unit 32 can further group the entire pixel luminance value scale, for example, 0-255, into a plurality of luminance levels. Thus, each frame pixel has a defined luminance level according to the luminance of each frame pixel. Therefore, a quantity of pixels in each luminance level can be derived. Then, according to the quantities of pixels, a plurality of pixel quantity intervals can be obtained by the luminance distribution detection unit 32, and thus the pixels of each luminance level fall into one of the pixel quantity intervals. For instance, if four pixel quantity intervals are required, a binary presentation such as 00, 01, 10, 11, can be used. More specifically, in this case 00 and 11 represent the minimum pixel quantity interval and the maximum pixel quantity interval, respectively. FIG. 4 illustrates the luminance distribution of a frame according to an embodiment where four pixel quantity intervals and five luminance levels are presented. The pulse width control circuit 33 includes a comparison unit 331, a compensation unit 332 and a pulse width adjustment unit 333. The comparison unit 331 can output a luminance difference, which operates similarly to the comparison unit 121 of the embodiment shown in FIG. 1. The compensation unit 332 receives both the average luminance and the pixel luminance distribution of the frame in process from the average luminance detection circuit 31 and the luminance distribution detection unit 32 respectively, then compensation unit 332 generates a compensation that can be used for adjusting the luminance difference output from the comparison unit 331. In the embodiment as shown in FIG. 1, the luminance difference is in proportion to the adjustment amount of the pulse width, and in the present embodiment, the adjustment amount of the pulse width is adjusted in a flexible way by different alternates of the compensation; that is, the pulse width of the PWM signal and the average luminance of the frame are not limited to be in linear relationship as shown in FIG. 2, and, in fact, the relationship may be non-linear (which will be described later).

In the embodiment, the compensation unit 332 includes an index generation unit 3321 and a look-up table (LUT) 3322. The index generation unit 3321 can generate an index according to the average luminance and the pixel luminance distribution of the frame; the LUT 3322 can store a plurality of compensation values, and a search according to the index generated by the index generation unit 3321 can be performed so that the compensation value corresponding to the index can be output. For example, and with reference to FIG. 4, the index generation unit 3321 may apply a corresponding weight to each luminance level, and obtain the summation of products of the pixel quantity intervals (00, 01, 10, 11 respectively represent the 0, 1, 2, 3) of luminance levels and the corresponding weights, for generating the index by comparing the summation with the average luminance of the frame. For example, if the summation above and the average luminance of the frame are respectively 5 bits, then the bits of the summation can be the Most Significant Bit (MSB) part, and the bits of the average luminance of the frame can be the Least Significant Bit (LSB) part in one embodiment, or vise versa, for generating an index value of 10 bits. If each compensation value is represented in a byte, then the LUT 3322 may be achieved by a storage space with $2^{10}$=1K byte.

The width adjustment unit 333 may generate a pulse width control signal according to the luminance difference output from the comparison unit 331 and the compensation output from the LUT 3322, then the pulse width control signal is transmitted to the pulse width modulator 34 for adjusting the pulse width of the PWM signal generated by the pulse width modulator 34.

Figure 5:
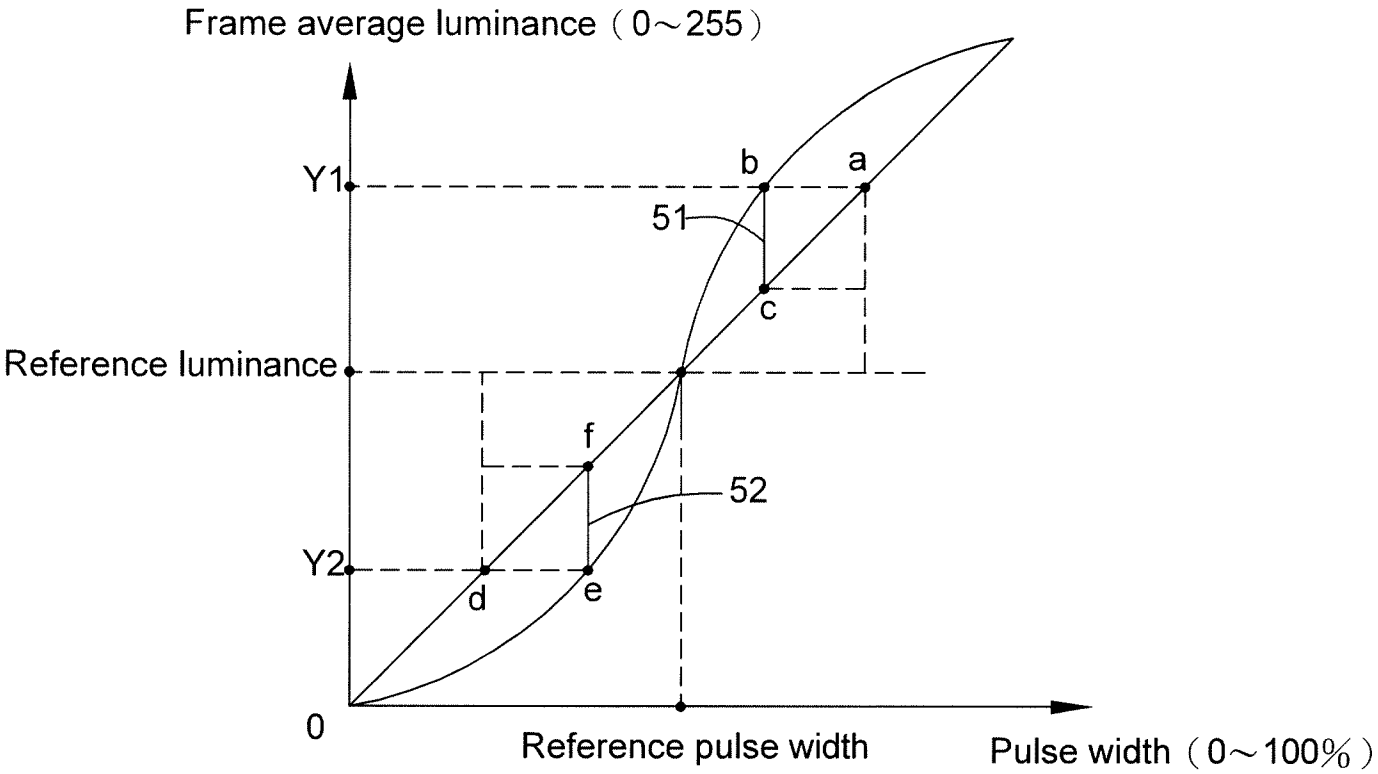
FIG. 5 is a block diagram of a backlight control circuit in another embodiment of the present invention.

FIG. 5 illustrates the relationship of the pulse width of the PWM signal and the average luminance of the frame in the instant embodiment of the present invention, wherein, the X-axis and the Y-axis are defined similarly to that in FIG. 2. In FIG. 5, the straight line represents the linear relationship of the pulse width and the average luminance of the frame as shown in FIG. 2 and the adjustment amount of the pulse width $\Delta W=\Delta L/s$ is obtained by knowing the luminance difference value $\Delta L$, s represents the slope of the straight line, as described above. And the curved line represents the relationship between the pulse width and the average luminance of the frame with adjustment of the compensation. As such, the adjustment amount of the pulse width $\Delta W$ is presented as $\Delta W=(\Delta L+\Delta C)/s$, where $\Delta L$ is the luminance difference and the $\Delta C$ is the compensation. In one embodiment, when the backlight is over a reference luminance value, the backlight originally determined by the linear relationship can become dimmer through applying the compensation with the curve relationship to satisfy power saving needs, for example. As shown in FIG. 5, for instance, a present average luminance of the frame is Y1, it is originally corresponding to the point a on the straight line where it maps to a certain pulse width value on the X-axis. If it is desired to have a lower pulse width (less bright backlight) at a point c on the linear line, then the average frame luminance must be lower than Y1. Because it is desired to maintain the average frame luminance at Y1 with the pulse width value at point c of the linear line, then application of a negative compensation value 51 to the luminance difference (which equals Y1 minus a reference luminance) is required. Therefore, a point b is obtained. A curved line to which point b belongs is obtained in a way that compensation is applied. Therefore, when the average frame luminance is greater than the reference value, after compensating, with the same frame luminance Y1, the pulse width becomes smaller, and the backlight goes dimmer with application of compensation. In the same embodiment, it is further designed that when the average luminance of the frame is below a reference luminance, the curved line is formed in a way that the pulse width is greater (a brighter backlight) by application of the compensation, for displaying more details of the frame. More specifically, with reference to FIG. 5, when the present average luminance of the frame is Y2, it corresponds to a point d on the linear line. Y2 also corresponds to a point e on the curved line. It can be derived that point e corresponds to a point f on the linear line where both point e and point f have the same pulse width. With application of a compensation value 52, point e has the same average luminance Y2 with a greater pulse width compared to that of point d. Therefore, after compensating, the pulse width that corresponds to the average luminance Y2 of the frame becomes greater. It is noted that the curve and compensation value shown in FIG. 5 are only exemplary and should not limit the scope of the invention. In fact, when different compensations apply, different curves are generated.

As described above, the compensation is generated according to the average luminance of the frame and the pixel luminance distribution. The frames are determined to be bright, dark or at medium level according to the average luminance; the uniformity of quantities of pixels in luminance levels of the frame is obtained according to the pixel luminance distribution. Because the frames with the same average luminance may have different pixel luminance distributions, the frames can be grouped in more detail for compensating the backlight properly according to both the average luminance and the pixel luminance distribution. For example, when the average luminance of the frame is high, and if a majority of the pixels of the frame have the pixel luminance distribution of the brightest luminance level, then the compensation is to maintain enough backlight, and if the pixel luminance distribution is average, then the backlight can go dimmer with a different compensation such that the power consumption is reduced; when the average luminance of the frame is low, and if a majority of the pixels of the frame have the pixel luminance distribution of the lowest luminance level, then the compensation can maintain low backlight to enhance the dynamic contrast ratio; if the pixel luminance distribution is average, then it can make the backlight brighter by compensating, for presenting more details of the frame, and achieving a better image contrast ratio.

In FIG. 5, as an alternative, the width adjustment unit 333 may alter the extent of change of the adjustment amount of the pulse width in accordance with the compensated luminance difference (i.e., luminance difference+compensation), by adjusting the slope s. If taking 1/s as a gain, then the adjustment value of the pulse width is equal to a product of the luminance difference and the gain. With reference to FIG. 3, the pulse width control signal provided by the width adjustment unit 333 can control the pulse width modulator 34 to adjust the pulse width of the PWM signal according to the pulse width adjustment described above.

Figure 6:
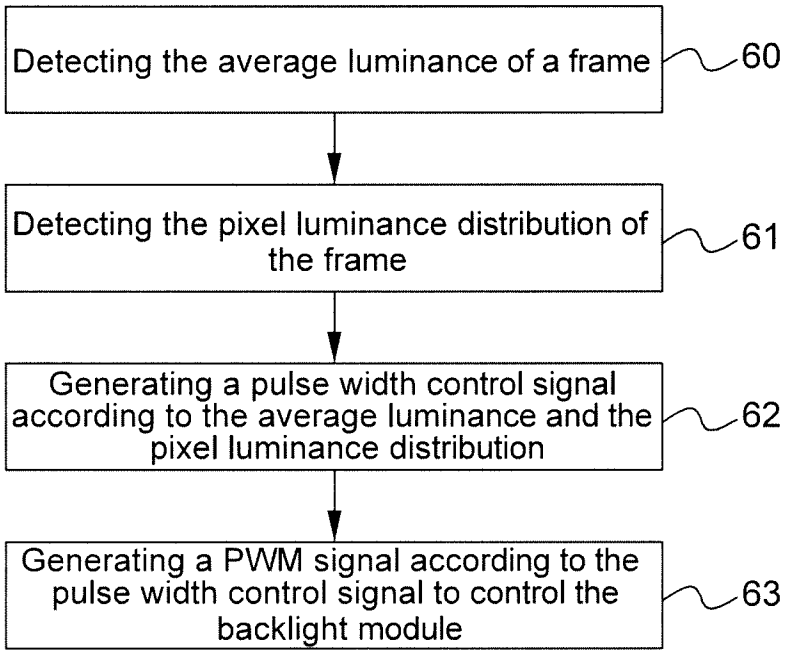
FIG. 6 is a flow chart of a backlight control method in accordance with an embodiment of the present invention.

In conclusion, in the embodiments of the present disclosure, the luminance of the backlight may change with the average luminance of the frame and the pixel luminance distribution, where embodiments can adjust the luminance of the backlight dynamically according to the pixel luminance distribution, for achieving a better image contrast ratio and reducing power consumption. FIG. 6 is a flow chart of the backlight control method according to an embodiment of the present invention, for controlling the backlight of a display device. Step 60 is for detecting the average luminance of a frame that is to be displayed of a display device. The frame includes a plurality of scanning lines, and each scanning line includes a plurality of pixels. For example, this step comprises calculating the average luminance of the pixels of each scanning line, then calculating the average of the pixels average luminance of the scanning lines to obtain the average luminance of the frame.

Step 61 is for detecting the pixel luminance distribution of the frame. For example, the step comprises grouping pixels into one of a plurality of luminance levels respectively according to the luminance of each pixel of the frame, and further calculating the pixel quantity of each luminance level. The step can further include defining several pixel quantity intervals so that each luminance level with a certain amount of pixels falls into one of the pixel quantity intervals, for representing the pixel luminance distribution of the frame.

Step 62 is for generating a pulse width control signal according to the average luminance and the pixel luminance distribution of the detection frame. For example, the step includes comparing the average luminance of the frame with a reference luminance, and outputting a luminance difference value, and generating a compensation signal according to the average luminance of the frame and the pixel luminance distribution; then generating a pulse width control signal according to the luminance difference and the compensation. The luminance difference may be the difference between the average luminance of the frame and the reference luminance, where the reference luminance corresponds to a reference pulse width, and the pulse width control signal corresponds to a pulse width adjustment. As an alternative, the average luminance of the frame may be stored in a register, and a previous luminance difference may be generated by comparing the average luminance of the frame prior to the present frame with the reference luminance. When the difference between the previous luminance difference and the luminance difference described above is less than a threshold, the methodology may output the previous luminance difference instead of the luminance difference described above, so that misjudgment resulting from noise interference can be avoided.

Step 62 is for generating compensation by, for example, generating an index according to the average luminance and the pixel luminance distribution of the frame, and then searching according to the index a look-up table (LUT) of a plurality of compensation values in order to output a compensation corresponding to the index. For example, if the pixel luminance distribution of the frame demonstrates the pixel quantity of each luminance grade, then the step includes generating the index according to the pixels of each luminance grade, for example, it may apply a weight to each luminance grade, and generate the summation of products of the pixel numbers of the luminance grades and the corresponding weights respectively, to generate the index. As an alternative, the adjustment of the pulse width may be in proportion to the sum of the luminance difference and the compensation. As still another alternative, the adjustment of the pulse width may be equal to a product of the luminance difference and the gain. In one embodiment, the adjustment value of the pulse width can be controlled by adjusting the gain.

Step 63 is for generating a PWM signal according to the pulse width control signal, and transmitting the pulse width control signal to the backlight module of the display device, for controlling the brightness of backlight. In other words, the pulse width of the PWM signal is dependent on the reference pulse width and the pulse width adjustment.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A backlight control circuit for controlling a backlight module in a display device, comprising:

an average luminance detection circuit, for detecting an average luminance of a frame that is to be displayed, the frame having a plurality of pixels;

a luminance distribution detection unit, for detecting a pixel luminance distribution of the frame;

a pulse width control circuit, coupled to the average luminance detection circuit and the luminance distribution detection unit, for generating a pulse width control signal according to the average luminance and the pixel luminance distribution; and a pulse width modulator, coupled to the pulse width control circuit, for generating a pulse width modulation (PWM) signal according to the pulse width control signal to control a backlight of the backlight module.

2. The backlight control circuit as claimed in claim 1, wherein the pixels form a plurality of scanning lines, and the average luminance detection circuit calculates a pixel average luminance of each scanning line and an average of the pixel average luminance of the scanning lines to detect the average luminance of the frame.

3. The backlight control circuit as claimed in claim 1, wherein the luminance distribution detection unit groups each pixel into one of a plurality of luminance levels according to a pixel luminance to determine a quantity of pixels in each luminance level.

4. The backlight control circuit as claimed in claim 3, wherein the luminance distribution detection unit classifies the quantity of pixels of each luminance level into one of a plurality of pixel number intervals.

5. The backlight control circuit as claimed in claim 1, wherein the pulse width control circuit comprising:

a comparison unit, for comparing the average luminance of the frame with a reference luminance to output a luminance difference;

a compensation unit, for generating a compensation value according to the pixel luminance distribution of the frame; and a width adjustment unit, coupled to the comparison unit and the compensation unit, for generating the pulse width control signal according to the luminance difference and the compensation value.

6. The backlight control circuit as claimed in claim 5, wherein, when a difference between a previous luminance difference and the luminance difference is less than a threshold value, the comparison unit outputs the previous luminance difference instead of the luminance difference.

7. The backlight control circuit as claimed in claim 5, wherein the compensation unit comprises:

an index generation unit, for generating an index according to the pixel luminance distribution of the frame; and a lookup table (LUT), coupled to the index generation unit, storing a plurality of compensation values, wherein the LUT outputs the compensation value corresponding to the index.

8. The backlight control circuit as claimed in claim 7, wherein the compensation unit generates the compensation value according to the average luminance and the pixel luminance distribution of the frame; and the index generation unit generates the index according to the average luminance and the pixel luminance distribution of the frame.

9. The backlight control circuit as claimed in claim 7, wherein the pixel luminance distribution of the frame comprises a plurality of pixel quantities corresponding to a plurality of luminance levels, and the index generation unit generates the index according to the pixel quantity in each luminance level.

10. The backlight control circuit as claimed in claim 9, wherein each luminance level has a corresponding weight, and the index generation unit generates the index according to the pixel quantity of each luminance level, the corresponding weight and the pixel luminance distribution.

11. A backlight control method for controlling a backlight module in a display device, the method comprising:

detecting an average luminance of a frame that is to be displayed, the frame having a plurality of pixels;

detecting a pixel luminance distribution of the frame;

generating a pulse width control signal according to the average luminance and pixel luminance distribution of the frame; and generating a pulse width modulation (PWM) signal according to the pulse width control signal, for controlling a backlight of the backlight module.

12. The backlight control method as claimed in claim 11, wherein the pixels form a plurality of scanning lines, the step of detecting the average luminance comprises:

calculating a pixel average luminance of each scanning line; and calculating an average of the pixel average luminance of the scanning lines to detect the average luminance of the frame.

13. The backlight control method as claimed in claim 11, wherein the step of detecting the pixel luminance distribution comprises grouping each pixel into one of the plurality of luminance levels to determine the number of pixels in each luminance level.

14. The backlight control method as claimed in claim 13, wherein the step of detecting the pixel luminance distribution comprises classifying the pixel quantity in each luminance level into one of a plurality of pixel quantity intervals.

15. The backlight control method as claimed in claim 11, wherein the step of generating the pulse width control signal comprises:

comparing the average luminance of the frame with a reference luminance, then outputting a luminance difference, wherein the reference luminance corresponds to a reference pulse width;

generating a compensation value according to the pixel luminance distribution of the frame; and generating a pulse width control signal according to the luminance difference and the compensation value, wherein the pulse width control signal controls a pulse width adjustment amount;

wherein, a pulse width of the PWM signal is determined depending on the reference pulse width and the pulse width adjustment amount.

16. The backlight control method as claimed in claim 15, wherein comparing the average luminance of the frame further comprises:

comparing a previous luminance difference and the luminance difference to obtain a difference there between;

comparing the difference with a threshold value; and if the difference is less than the threshold value, outputting the previous luminance difference.

17. The backlight control method as claimed in claim 15, wherein the step of generating the compensation comprises:

generating an index according to the pixel luminance distribution of the frame; and outputting the compensation value corresponding to the index from a lookup table (LUT) which stores a plurality of compensation values.

18. The backlight control method as claimed in claim 17, wherein the step of generating the compensation value comprises generating the compensation value according to the average luminance and the pixel luminance distribution of the frame; and the step of generating the index includes generating the index according to the average luminance and pixel luminance distribution of the frame.

19. The backlight control method as claimed in claim 17, the pixel luminance distribution representing a plurality of luminance levels associated with a plurality of quantities of pixels; wherein the step of generating the index comprises generating the index according to the quantity of pixels in each luminance level.

20. The backlight control method as claimed in claim 19, wherein each luminance level has a corresponding weight, and the step of generating the index comprises generating the index according to the quantity of pixels in each luminance level and the corresponding weight.

* * * * *